US007623071B2

(12) United States Patent
Ginn et al.

(10) Patent No.: US 7,623,071 B2
(45) Date of Patent: Nov. 24, 2009

(54) SUB-MILLIMETER AND INFRARED REFLECTARRAY

(75) Inventors: James Ginn, Longwood, FL (US); Brian Lail, West Melbourne, FL (US); Glenn Boreman, Geneva, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 157 days.

(21) Appl. No.: 11/609,118

(22) Filed: Dec. 11, 2006

(65) Prior Publication Data

US 2007/0132645 A1 Jun. 14, 2007

Related U.S. Application Data

(60) Provisional application No. 60/749,248, filed on Dec. 9, 2005.

(51) Int. Cl.
*H01Q 1/38* (2006.01)

(52) U.S. Cl. ..... 343/700 MS; 343/795; 343/872

(58) Field of Classification Search ..... 343/700 MS, 343/795, 872, 873, 896, 787
See application file for complete search history.

(56) References Cited

U.S. PATENT DOCUMENTS 3,924,239 A 12/1975 Fletcher et al.
3,975,738 A 8/1976 Pelton et al.
4,017,865 A 4/1977 Woodward
4,125,841 A 11/1978 Munk
4,126,566 A 11/1978 Pelton
4,656,487 A 4/1987 Sureau et al.
6,035,089 A 3/2000 Grann et al.
6,476,465 B2 * 11/2002 Hirose ..... 257/666
6,720,926 B2 * 4/2004 Killen et al. ..... 343/700 MS
6,750,740 B2 * 6/2004 Killen et al. ..... 333/204
6,842,140 B2 * 1/2005 Killen et al. ..... 343/700 MS
6,947,005 B2 * 9/2005 Aisenbrey ..... 343/789
6,995,711 B2 * 2/2006 Killen et al. ..... 343/700 MS
7,135,134 B2 * 11/2006 Tepper et al. ..... 264/10
2006/0085160 A1 * 4/2006 Ouchi ..... 702/150

* cited by examiner

*Primary Examiner*—Douglas W. Owens
*Assistant Examiner*—Chuc Tran
(74) *Attorney, Agent, or Firm*—Patents On Demand, P.A.; Neil R. Jetter

(57) ABSTRACT

An integrated sub-millimeter and infrared reflectarray includes a reflective surface, a dielectric layer disposed on the reflective surface, and a subwavelength element array and a subwavelength element array electromagnetically coupled to the reflective surface. The subwavelength element array includes (i) electrically conductive subwavelength elements on the dielectric layer, (ii) wherein the dielectric layer comprises a plurality of dielectric subwavelength elements, or (iii) the dielectric layer includes a plurality of embedded dielectric subwavelength elements. The array includes at least one of a plurality of substantially different inter-element spacings and a plurality of substantially different dimensions for the elements.

12 Claims, 11 Drawing Sheets

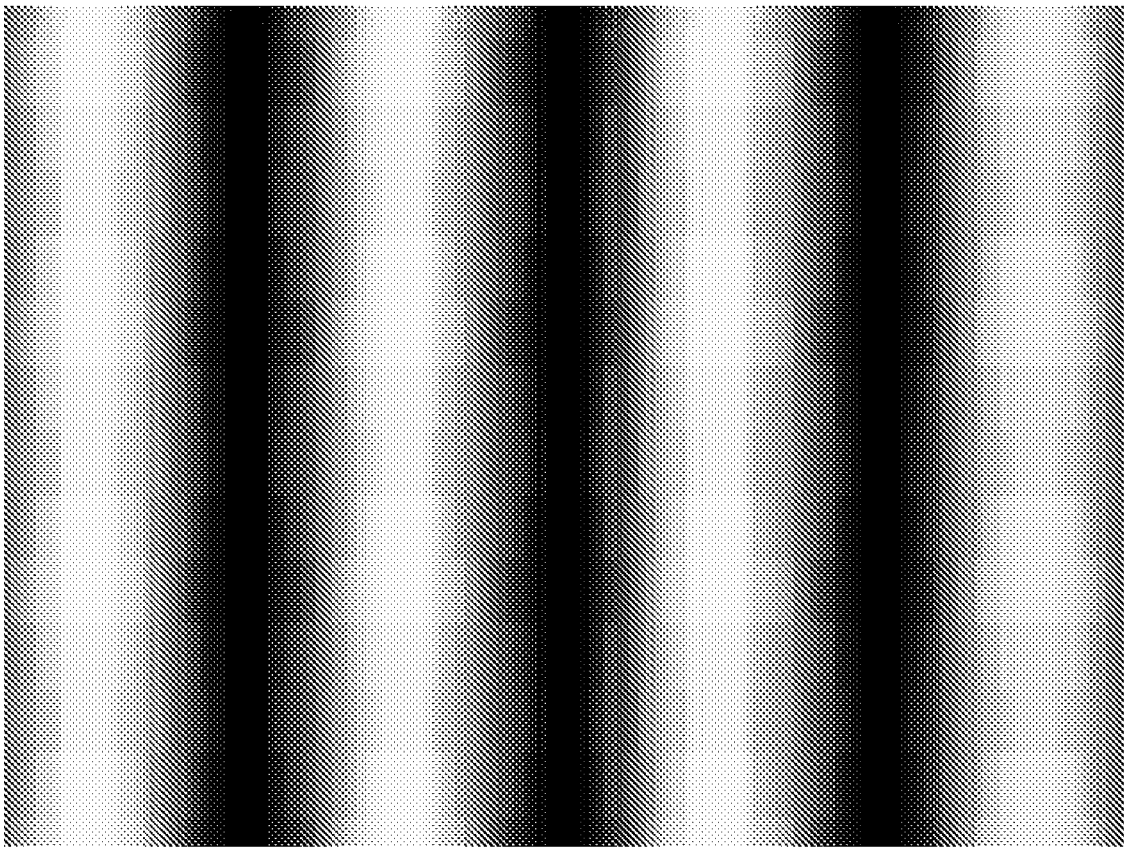
Interferogram of Reference (Fig 5)

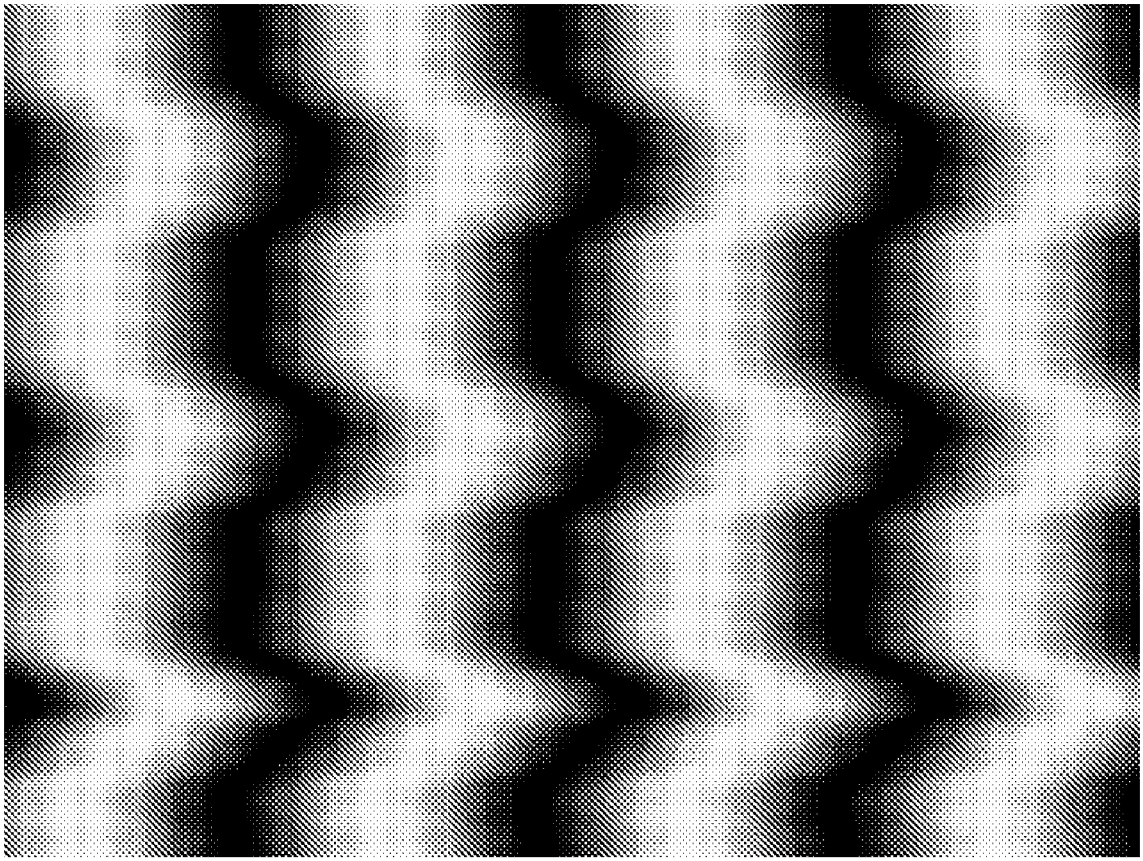
Interferogram of Reflectarray #1 (Fig 6)

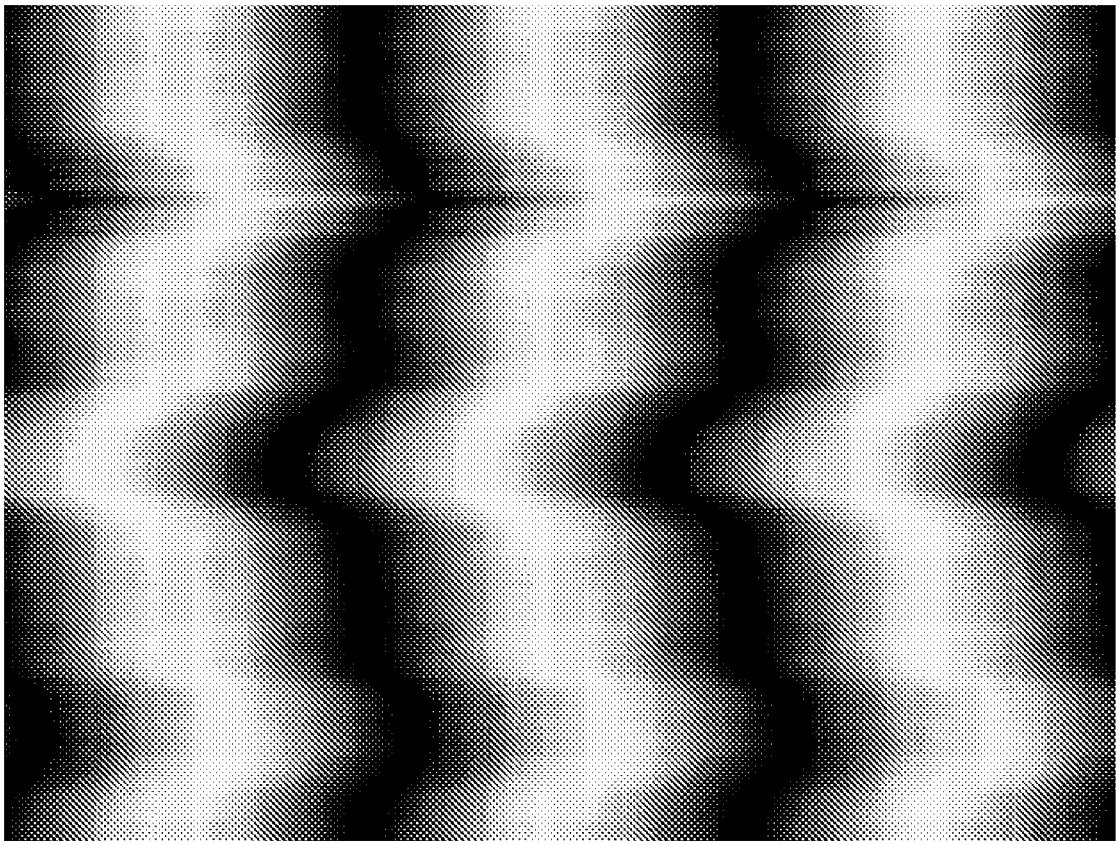
Interferogram of Reflectarray #2 (Fig 7)

SUB-MILLIMETER AND INFRARED REFLECTARRAY

CROSS-REFERENCE TO RELATED APPLICATIONS

This application claims the benefit of U.S. Provisional Application No. 60/749,248 entitled "SUB-MILLIMETER AND INFRARED REFLECTARRAY", filed on Dec. 9, 2005, the entirety of which is incorporated herein by reference.

STATEMENT REGARDING FEDERALLY SPONSORED RESEARCH OR DEVELOPMENT

Not applicable.

FIELD OF THE INVENTION

The invention relates to reflector antenna technology, more specifically to integrated reflectarrays.

BACKGROUND

A conventional reflector antenna is parabolically shaped to provide focusing of plane waves. A "Flat Parabolic Surface" (FLAPS™) is a device currently marketed by Malibu Research, Camarillo Calif. FLAPS™ is an antenna design which utilizes a geometrically flat surface having surface features which behaves electromagnetically for incident RF radiation as though it were a parabolic reflector.

The FLAPS™ generally consists of an array of dipole scatterers. The elemental dipole scatterer consists of a dipole positioned approximately ⅛ wavelength above a ground plane on top of a dielectric layer. Incident RF energy causes a standing wave to be set up between the dipole and the ground-plane. The dipole itself possesses an RF reactance which is a function of its length and thickness. This combination of standing-wave and dipole reactance causes the incident RF to be reradiated with a specific phase shift, which can be controlled by a variation of the length of the dipole. The exact value of the this phase shift is a function of the dipole length, thickness, its distance from the ground-plane, the dielectric constant of the intervening layer, and the angle of the incident RF energy. When elements are used in an array, the elements are affected by nearby elements.

The elemental scatterer performs the function of a radiating element and a phase shifter in a space fed phased array. Since dipoles of different lengths will produce a phase shift in the incident wave, arranging the distribution and the lengths of the dipoles can be used to serve to steer, focus or shape the reflected wave. An array of such elements can be designed to reradiate with a progressive series of phase shifts so that an RF beam is formed in a specific direction. Conventional reflector antenna calculations apply to determine surface tolerances, gain, sidelobes, and other electrical antenna parameters.

Although FLAPS™ provides effective signal processing for incident RF energy, the minimum obtainable geometries being mm-scale for forming FLAPS™ surfaces based on a process comprising etching from double-layer printed-circuit boards generally limits signal processing to RF wavelengths up to only about 100 GHz. Reflectarrays that process higher frequency bands (greater than 300 GHz), such as sub-millimeter, infrared and visible, would be desirable to replace more expensive and sometimes unreliable conventional polished or diffractive optics and quasi-optics. However, besides strong challenges in obtaining required feature sizes to process shorter wavelength radiation, such a device would need to overcome challenges including modeling complexities and lack of suitable modeling software, increased attenuation loss in metals, and frequency dependent dielectric properties.

BRIEF DESCRIPTION OF THE DRAWINGS

There are shown in the drawings embodiments which are presently preferred, it being understood, however, that the invention can be embodied in other forms without departing from the spirit or essential attributes thereof.

FIG. 1(*b*) shows a highly simplified portion of a dielectric reflectarray (DR) according to an embodiment of the invention comprising an array of dielectric elements disposed on a reflective surface/ground plane. Although only four (4) elements are shown, practical DRs generally comprises millions or billions of individual dielectric elements.

FIG. 1(*c*) shows a highly simplified portion of a dielectric reflectarray (DR) according to an embodiment of the invention comprising a dielectric layer comprising a plurality of embedded dielectric elements. Although not shown, practical DRs based on embedded elements generally comprises millions or billions of individual dielectric elements.

FIG. 2(*b*) shows a simplified model depiction a reflectarray according to the invention designed to planarize an infrared spherical wave front.

FIG. 3(*b*) is a scanned image showing three (3) rows of elements, the rows being equally spaced, with each row having different size electrically conductive elements.

FIG. 5 shows a scanned interferogram of a reference wafer illustrating no significant reflected phase aberrations.

FIGS. 6-7 shows scanned interferogram images of a CR proof of concept with a variable number of fringes across the wafer illustrating controlled phase manipulation.

SUMMARY

Figure 1A:
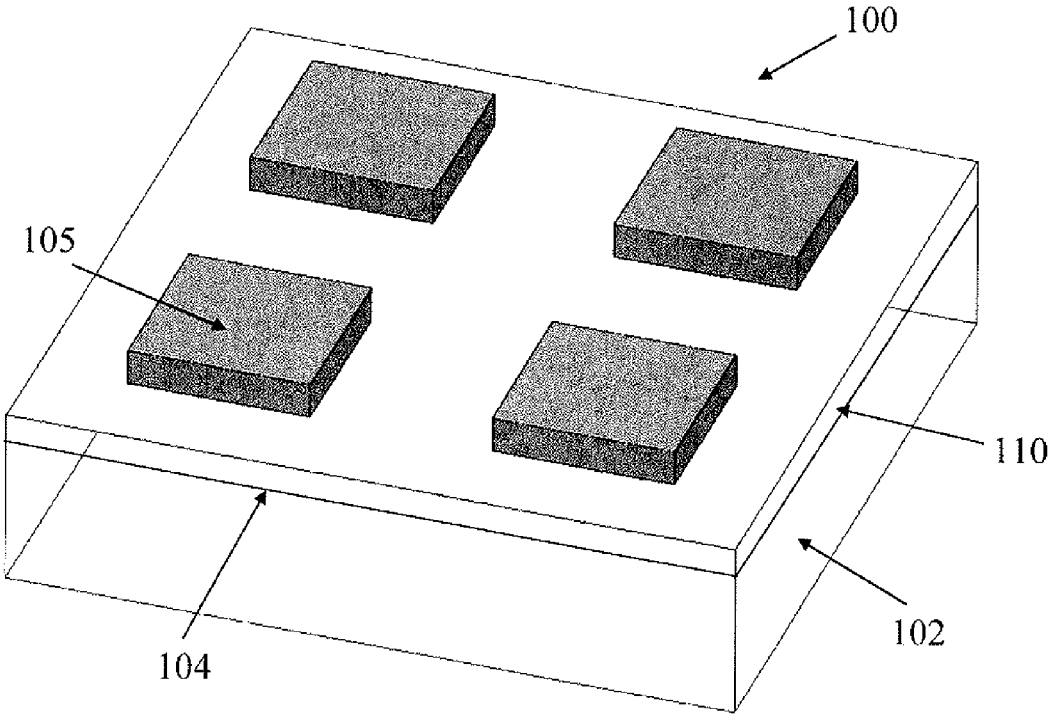
FIG. 1(*a*) shows a highly simplified portion of a conductive reflectarray (CR) according to an embodiment of the invention comprising an array of electrically conductive elements disposed on a dielectric layer. Although only four (4) elements are shown, practical CRs generally comprises millions or billions of individual conductive elements.

An integrated sub-millimeter and infrared reflectarray includes a reflective surface, a dielectric layer disposed on the reflective surface, and a subwavelength element array electromagnetically coupled to the reflective surface, the subwavelength element array comprising:

(i) electrically conductive subwavelength elements on said dielectric layer, (ii) wherein said dielectric layer comprises a plurality of dielectric subwavelength elements, or (iii) said dielectric layer includes a plurality of embedded dielectric subwavelength elements, The element array includes at least one of a plurality of substantially different microscale inter-element spacings and a plurality of substantially different microscale dimensions for the elements.

As used herein, "subwavelength" refers to element dimensions or inter-element spacings that are less than the wavelength of the radiation being processed by the reflectarray. "Microscale" as used herein refers to dimensions less than 1 mm, typically being 1 to 10 μm.

Regarding the embedded dielectric feature embodiment, the embedded dielectric subwavelength elements can comprise voids in the dielectric layer. In this embodiment, the embedded dielectric subwavelength elements preferably comprise a dielectric material having a dielectric constant lower than a high dielectric constant material comprising the dielectric layer.

Regarding the embodiment where the dielectric layer comprises a plurality of dielectric subwavelength elements, the dielectric layer can comprise Si or Ge. A planar substrate support can be interposed between the dielectric layer and the reflective surface.

The microscale elements can have length and width dimensions both from 1 to 10 microns. In one embodiment, the thickness of the dielectric layer is from 200 to 600 nm. The dielectric layer can comprise $ZrO_2$ or BCB. An operating frequency band of said the reflectarray can be in a range between 1 THz and 500 THz.

DETAILED DESCRIPTION

An integrated sub-millimeter and infrared reflectarray includes a reflective surface, a dielectric layer disposed on the reflective surface, and a subwavelength element array and a subwavelength element array electromagnetically coupled to the reflective surface, the subwavelength element array comprising (i) electrically conductive subwavelength elements on the dielectric layer, (ii) wherein the dielectric layer comprises a plurality of dielectric subwavelength elements, or (iii) the dielectric layer includes a plurality of embedded dielectric subwavelength elements. The element array includes at least one of a plurality of substantially different microscale inter-element spacings and a plurality of substantially different microscale dimensions for the elements.

As used herein, "substantially different" as applied to inter-feature spacing and element dimensions refers to a range of at least 0.5%. In the case of element dimensions, only one of the thickness, length and width need be substantially different. An array having different inter-feature spacing and element dimensions is also within the scope of the present invention. The reflectarray may also include a substrate support, such as silica, which can be planar or non-planar.

As defined herein, a "reflectarray" is a passive structure, made up of an element array comprising hundreds of thousands, millions, or billions of discrete elements. The elements can be electrically conductive or dielectric elements with each element in the array having specific reflectivity characteristics that in combination provides reflected phase front manipulation. When the reflectarray design is based on electrically conductive microscale elements, the reflectarray is referred to herein as a conductive reflectarray (CR). Electrically conductive elements include metal, highly doped semiconductors, as well as polymeric conductors. When the reflectarray design is based on dielectric microscale elements, the dielectric elements are either etched into the dielectric layer, or the dielectric layer comprises an array of dielectric microscale elements disposed on the reflective surface, the reflectarray being referred to herein as a dielectric reflectarray (DR).

In the case of the DR embodiment having the dielectric elements on the reflective surface, the dielectric is generally deposited onto the reflective surface of the reflectarray in the desired geometrical shapes using a standard e-beam development process. In the case of the DR embodiment having the elements etched into the dielectric layer, the dielectric material is generally uniformly deposited across the reflective surface of the reflectarray to form a thin film. An etch or other removal process is preferably used to selectively remove dielectric regions to form a pattern of voids, leaving behind the desired geometric pattern in dielectric. Optionally, the voids can be filled with a dielectric material different from the dielectric material comprising the dielectric layer, generally providing a lower dielectric constant.

As defined herein the term "reflective surface" refers to a surface which provides enough reflectivity for adequate reflectarray operation in a desired operating band. Adequate reflectivity is generally at least 50%, and is preferably at least 70%, and most preferably at least 90%. Generally, the reflective surface will comprise a ground plane.

However, reflective surfaces according to the invention can comprise reflective structures other than ground planes, such as distributive Bragg reflectors (DBR) and photonic band gap structures. For example, U.S. Pat. No. 6,035,089 to Grann et al. discloses photonic band gap structure comprising a resonant grating structure in a waveguide and methods of tuning the performance of the grating structure. Moreover, the reflective surface can comprise a frequency selective surface (FSS).

As defined herein the term "sub-millimeter and infrared" refers to wavelengths less than about 1 millimeter, or equivalently, frequencies greater than about 300 GHz. In one embodiment, the operating frequency is in the THz range, such as 1 to 500 THz.

Figure 1B:
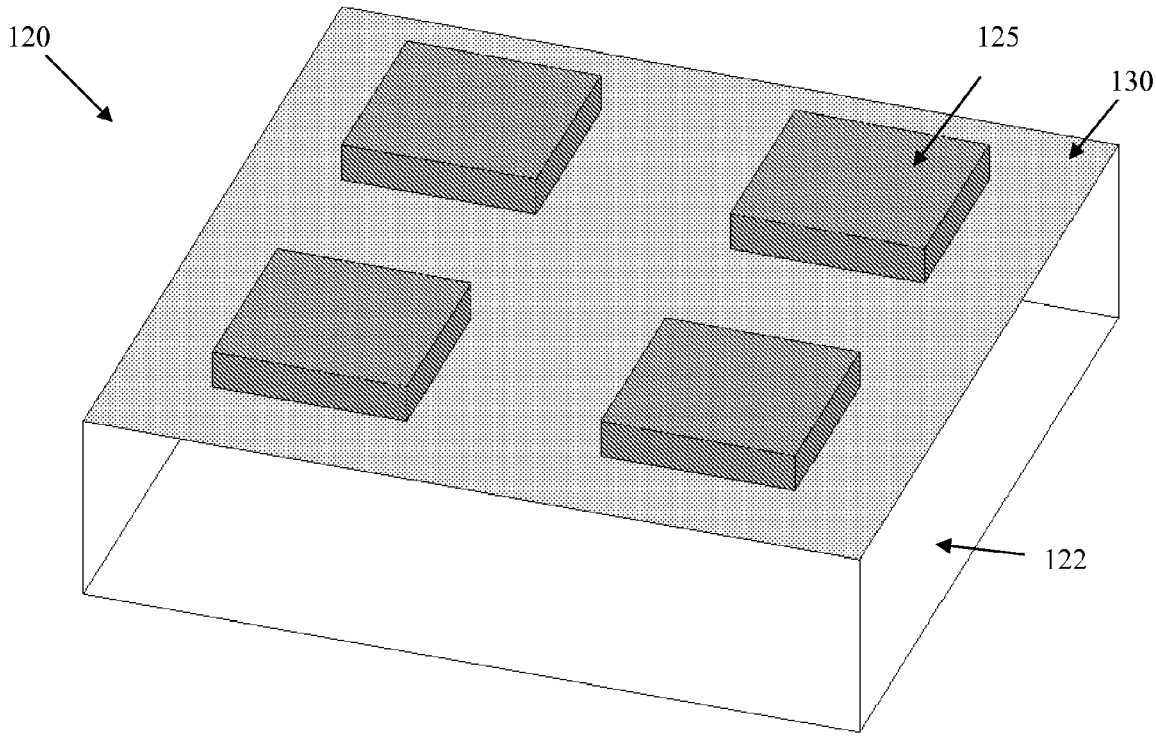
Figure 1C:
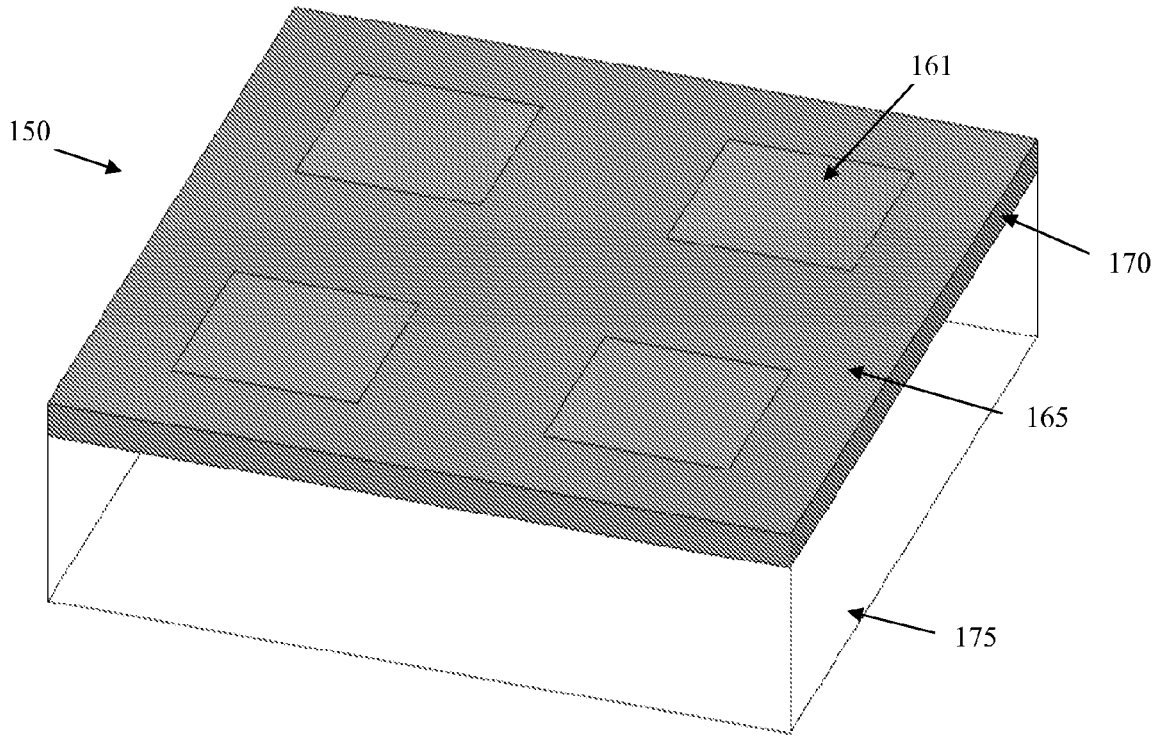

FIG. 1(*a*) shows a highly simplified portion of a conductive reflectarray (CR) 100 according to an embodiment of the invention. CR 100 includes an array of electrically conductive elements 105 disposed on a dielectric layer 110. Although four (4) elements 105 are shown, CR 100 generally comprises millions or billions of individual electrically conductive elements. Supporting substrate 102, such as a silica substrate, is shown. Ground plane 104 such as a Au layer, is beneath dielectric layer 110.

FIG. 1(*b*) shows a highly simplified portion of a dielectric reflectarray (DR) 120 according to an embodiment of the invention. DR 120 includes an array of dielectric elements 125 on a reflective surface/ground plane 130. As with CR 100, although only four (4) elements 125 are shown, DR 120 generally comprise millions or billions of individual elements. A substrate 122 shown in FIG. 1(*b*) is also generally provided for mechanical support.

FIG. 1(*c*) shows an simplified portion of a dielectric reflectarray (DR) 150 according to an embodiment of the invention based on the dielectric layer comprising a plurality of embedded dielectric elements 161 within a dielectric layer 165. Dielectric layer 165 is disposed on a reflective surface/ground plane 170. A substrate 175 shown in FIG. 1(*c*) is also generally provided for mechanical support. Embedded dielectric elements 161 shown are periodic and four (4) elements in total are shown. As with CR 100 and DR 120, although only four (4) embedded dielectric elements 161 are shown, DR 150 generally comprises millions or billions of individual embedded dielectric elements. The material comprising embedded dielectric elements 161 preferably provides a dielectric constant that is significantly lower as compared to the higher dielectric constant material comprising dielectric layer 165. In one embodiment the embedded dielectric elements 161 can comprises-voids which are generally filled with air. Embedded dielectric elements 161 can be a portion of or the full thickness of dielectric layer 165. Such a structure can behave based on the same principle as the DR 150 shown FIG. 1(*b*), and is particularly useful if a second layer is desired to be developed on top of a DR, or if the dielectric elements in the DR require structural support.

The reflectarray is generally an integrated reflectarray. As defined herein the term "integrated" refers to one piece structural member formed using conventional integrated circuit processing, such as using depositions, lithography and etching. Integrated devices may be contrasted with devices having two or more separate components, as provided by conventional polished optics or diffractive optics based devices. Integrated circuit processing leads to low cost since a given wafer generally provides hundreds or thousands of die, and the ability to form electronic, optical and/or MEMS devices on the same die.

Although not seeking to be bound by the mode of operation, nor necessary to practice the CR embodiment of the present invention, the Inventors provide the following regarding the mode of operation. The desired reflected phase front modification from incident radiation is achieved by the electrically conductive microscale elements, which electronically introduces desired degrees of phase shift to the incident radiation at each small unit cell of the structure. It is the interaction between the electrically conductive microscale elements, the dielectric layer, and the reflective surface, in the presence of an incident radiation, which causes the incident radiation to be reflected by each unit cell with a specific phase shift to introduce constructive and destructive interference to form a desired reflected phase front.

It is believed that the far-field reflected phase for CR reflectarrays according to the invention can be controlled almost entirely by the dimensions of the array elements if all other dimensions of the design are held constant. As a general rule of thumb, the nominal element dimensions are about 50% of the wavelength of the radiation to be processed when using a low loss, low permittivity dielectric and half-wave element spacing. Exemplary elements include a patch, a stub tuned patch, and a crossed dipole. Examples of other various known electromagnetically-loading elements which may be used with the present invention can be found in U.S. Pat. Nos. 4,656,487; 4,126,866; 4,125,841; 4,017,865; 3,975,738; and 3,924,239. In a preferred embodiment, an array of variable size patches is used.

Variable size patches are generally preferred because they support polarization selectivity, are generally easier to fabricate, faster to model, and do not require stacking to achieve desired reflectarray behavior. Moreover, at least for RF applications, it is known that the variable size patch reflectarrays have wider operating bandwidths than other common element layouts.

Conductive reflectarrays are generally formed by varying the dimensions of a patch (or other element) on top of a ground plane backed short dielectric layer. There exists a band (range) of patch sizes where the reflection coefficient will go through approximately 360° of phase shift. Re-radiation inside this operating band occurs both due to the ground plane and the patch. Re-radiation outside this band occurs largely due to a single dominant element (ground plane or patch).

The dielectric layer for the CR should generally be very thin relative to wavelength of the radiation and provide a low permittivity and loss. $ZrO_2$ is a preferred dielectric since it provides both low loss and low permittivity from 1-11 μm. Bis-benzocyclobutene (BCB) is also a preferred dielectric due to its low loss and low permittivity in the infrared band and its ability to be deposited by a spin coating process. The height of the dielectric will generally determine the phase-transition range. The permittivity of the dielectric will generally determine the optimum median patch size.

Although not seeking to be bound by the mode of operation, nor necessary to practice the DR embodiment of the present invention, the Inventors provide the following regarding mode of operation. If a thin film is deposited on top of a perfectly reflecting surface, the phase and magnitude of a monochromatic wave reflected off this two material surface will be almost entirely dependent on the thickness and permittivity of the film and the orientation of the incident electric field. If the dielectric film is replaced with a periodic, sub-wavelength array of composite materials containing two dielectrics, the effective index, or permittivity, that the incident wave will observe will be determined by the index of the two composite materials and their periodic size ratio (the more of one material provided the more effect it will have on the effective index of the composite thin film).

For the DR, phase control is generally achieved by varying the periodic size ratio across the device with a fixed periodicity and thickness to vary effective permittivity only, just as the size of the conductive elements is varied in the CR design as described above. For the DR design, it is generally preferable to use the largest range of permittivities possible. Accordingly, the void can be filled with air (permittivity of 1) and the dielectric comprise a high permittivity, low loss dielectric, such as Silicon (Si; Si real part of permittivity is about 11.5) or Germanium (Ge; Ge real part of permittivity is about 16).

Unlike many traditional scattering devices such as frequency selective surfaces (FSS) which generally use a single element replicated a plurality of times, no practical design equations or reasonable analytical approaches exist for reflectarrays according to the invention when multiple element sizes, or element spacings, are used in the array. To overcome this challenge, numerical electromagnetic solvers have been utilized for the invention to predict reflectarray behavior of single elements making up the reflectarray device. One method of modeling reflectarrays according to the invention uses HFSS™ (a numerical solver) provided by Ansoft Corp. HFSS™ (Ansoft Corporation Pittsburgh, Pa.) is widely used for the design of on-chip embedded passives, PCB interconnects, antennas, RF/microwave components, and high-frequency IC packages. Modeling of the aggregate device can be approximately modeled using a ray-tracing solver, such as Optical Research Associates Code V™ (Pasadena, Calif.).

Before fabrication of a new design, element (e.g. patch) dimensions are determined for the reflectarray to provide the desired operation, such as focusing for IR radiation, for example. Numerical modeling takes into account system non-idealities, such as lossy materials or surface coupling, which are difficult to incorporate into the simple analytical approaches without a significant increase in complexity. In HFSS™, the behavior of individual element dimensions can be determined by developing an appropriate representative model of the element and bounding the single element with periodic boundaries to approximate an infinite array. The periodic boundaries generally lead to some inaccuracy because the actual reflectarray elements will not be in an infinite array and the element may be placed next to elements with different dimensions. This error generally can only be accounted for through measurement. Excitation of the model is either a plane wave or a wave port, with appropriate polarization and angle of incidence reflective of the actual excitation of the desired reflectarray. Determination of the phase and magnitude response of the reflectarray element can be found from the scattering matrix calculated at the wave port or the phase of the calculated far-field electric field.

Figure 2A:
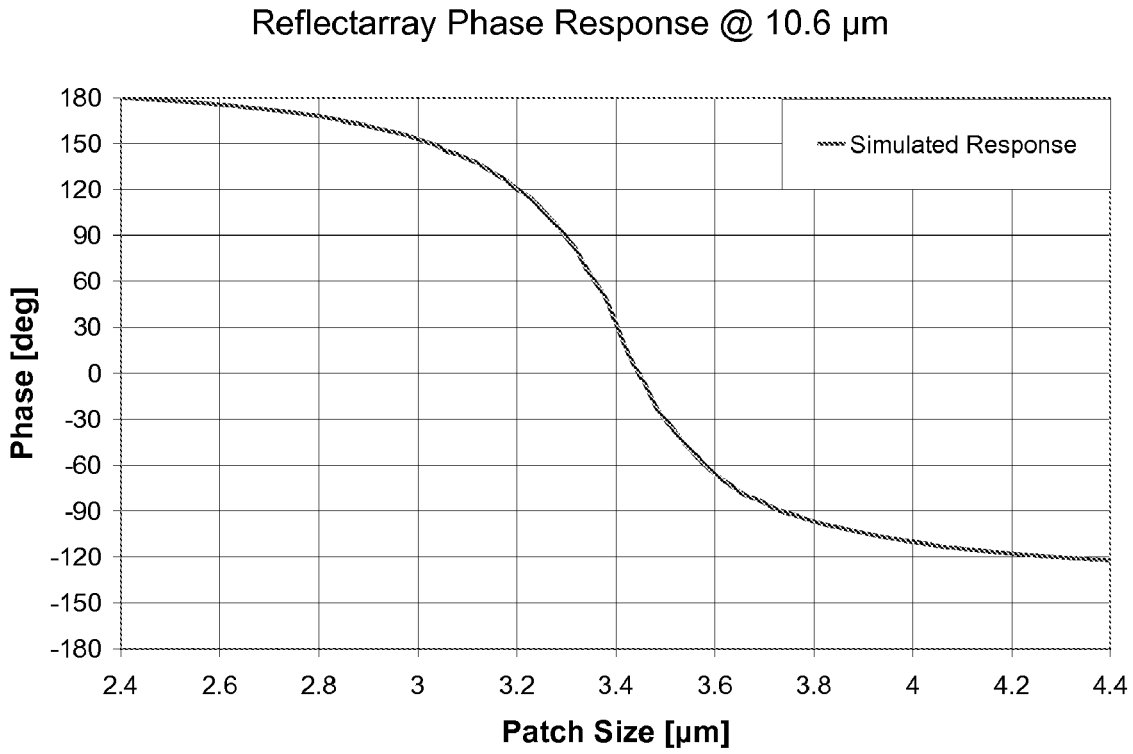
FIG. 2(*a*) shows array modeling results for the near-field reflected phase as a function of patch size (square patch; in μm) for a single cell, wherein the patches are on a BCB dielectric above a gold ground plane.
Figure 2B:
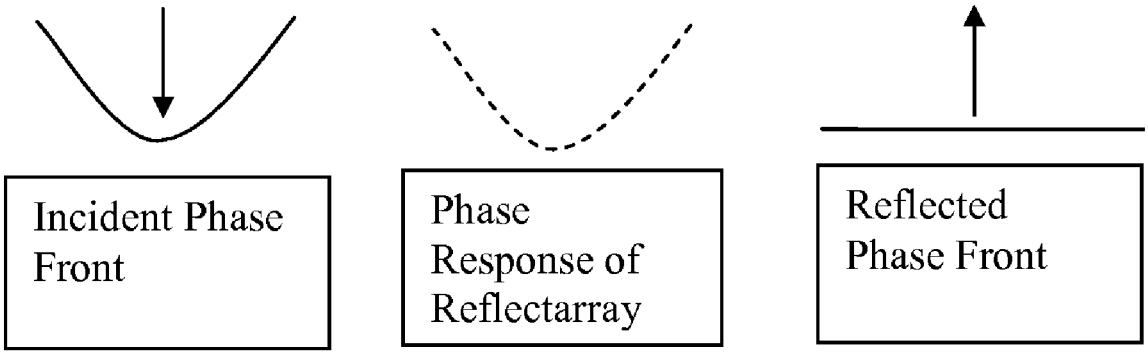

In most cases, it is not desirable to determine the phase response of an element with only a single fixed dimension. Thus, several various element dimensions are generally characterized while fixing all other dimensions (thickness, materials, etc.). FIG. 2(*a*) displays a simulated typical phase response of CR patch square elements for 10.6 μm radiation as a function of varying the width and length equally for elements within a fixed until cell size. The unit cell was 5.5 μm by 5.54 μm, where the patch is within the unit cell. In general, the zero degree phase shift value is selected to be near ½ of the wavelength of the radiation in the media of the reflectarray. It can be seen that a phase shift from +180 degrees to −120 degrees is provided for 10.6 μm wavelength (free space) radiation by changing the patch dimension of the square patch from 2.4 to 4.5 μm.

With knowledge of the phase response associated with each dimension variation, and the wavelength band to be processed, it is possible to begin constructing the aggregate reflectarray device. It is assumed the incident phase front will be known in advance and, thus, it should be possible to determine the desired phase response discretely across the reflectarray for an arbitrary reflected phase front, as described above.

For example, FIG. 2(*b*) shows a simplified model depiction a reflectarray according to the invention designed to planarize an incident spherical wave front. The incident phase front to be planarized has the spherical phase as a function of relative distance depicted in FIG. 2(*b*). A reflectarray according to the invention having the phase response as a function of relative distance shown using dashed lines in FIG. 2(*b*) is provided. Such a response can be realized by providing a minimum patch size in the center of the array and aligning the wave front to the center of the array, wherein domains of increasing patch size are provided to provide an decrease in phase shift as shown in FIG. 2(*a*) to closely match the phase as a function of distance shape depicted in FIG. 2(*b*) for the incident phase front to be planarized. As a result, the resulting reflected phase front as shown becomes planar as desired. As those having ordinary skill in the art will recognize, reflectarrays according to the invention can process a variety of incident phase front shapes, and provide a variety of reflected phase front responses.

For more advanced applications, where phase front is significantly complicated, it may be desirable to approximate the reflectarray as an ideal surface or thin film and model its response using a ray tracing package, such as Code V™. With Code V™, the response of the reflectarray can be refined and more advanced analysis, such as aberration correction, can be explored.

It is noted that neither modeling approach, HFSS™ or Code V™, can fully characterize the response of the entire array electromagnetically. Given the large number of elements present in the proposed invention, the amount of time and computing resources necessary to determine the response of the aggregate device is not practical to implement or advised. Thus, final determination of desired operation will generally require actual measurement followed by iterative design.

In iterative design, the initial reflectarray design from modeling can be tested with an interferometer, such as the Twyman Green. In the Twyman Green configuration, it is possible to measure the reflected phase behavior of the initial design to incident monochromatic, collimated light, assuming some nominal conditions, by calculating the relative phase change from the shifting of the interference fringes. These measurements can be compared to modeled results and further revisions can be made to improve the design, if desired.

For operation at sub-millimeter and infrared wavelengths, fine geometry features are required, such as submicron line widths. One method for forming the required fine features is using electron beam lithography (EBL). Although EBL is preferred, other methods for forming fine features may be used with the invention including optical lithography or nano-imprint lithography.

As described below, several insights were necessary to arrive at the present invention that were contrary to the understandings and expectations known by those having ordinary skill in the art at the time of the invention. Moreover, the invention provides several unexpected results and at least one new application.

Regarding materials, in traditional RF designs, material dispersion is not normally a design constraint or consideration. However, at infrared and shorter wavelengths, very few materials illustrate stable material characteristics (electrical conductivity or permittivity) over the entire spectral band. Not only does this place an additional constraint on the design of a hypothetical IR reflectarray, but it gives rise to questions regarding what type of bandwidth could be expected from such a reflectarray. For example, prior to the invention it was not clear what response would be produced by illuminating a hypothetical IR reflectarray at a frequency that is not the design frequency. At RF, this can be easily predicted with a good degree of accuracy using fairly simple analysis or modeling. At IR, however, predicting this behavior is considerable more problematic with the variation of material properties directly impacting in a generally adverse manner reflectarray behavior.

Regarding fabrication, at RF, electrical conductivity is generally very high and often is treated as perfect or nearly perfect. However, the electrical conductivity of most metals varies significantly with frequency. At IR, the electrical conductivity is general much lower and lossier making modeling and device design more difficult. For example, even gold, found to be one of the best electrical conductors at IR, has an electrical conductivity about 100 times smaller than its DC electrical conductance.

Regarding aperture size, conventional RF reflectarrays may only require 100 or less elements, such as for a reflector dish system. Even known (non-integrated) millimeter wave designs utilize only a few thousand elements. Prototypes described herein have been found to require several million elements for practical IR operation, such as for processing typical laser spot sizes or collimated space, for example, 17.2 million elements for devices described herein.

The response of the reflectarray according to the invention has been found to be driven by aggregate or array response more than the individual elements making up the array. In RF systems having about 100 elements, it is critical that each individual element in the design deliver the desired phase response. Thus, in such a system, one element can greatly change the behavior of the reflectarray. In a reflectarray system with several million or billion elements according to the invention, although a single element will give rise to some limited variation, it is highly unlikely that variation will give rise to any noticeable change in the optical response of the reflectarray. Instead, the optical response will be driven by the aggregate response of all the elements in a region of size corresponding to the spatial resolution of the system. In turn, this leads to the realization of composite arrays according to the invention. One possible way to meet an arbitrary phase response, is to create a periodic array of multiple elements (e.g. two different elements next to each other) such that the aggregate array of the elements provides the desired single phase response.

Applications for reflectarrays according to the invention include planar focusing elements, with or without polarization sensitivity. Another application includes aberration correction or characterization. In aberration correction, the layout of the reflectarray elements are arranged introduce a phase variation upon reflection for the purpose of compensating phase aberrations in the incident phase front. A variety of other related devices can be formed using the invention. Radiation detectors can be formed by configuring the array elements to provide a highly transmissive band adjacent to a reflective band or to provide simultaneous detection and phase front augmentation. A device can comprise a plurality of stacked reflectarrays, where one reflectarray acts as a ground plane for the array stacked thereon for the purpose of broadband or multiple band operation.

Although describes above as being either a CR or DR, dielectric elements, voids and electrically conductive elements be combined, such as each having a portion of the area of an array. Such a design could be used for dual frequency designs with one portion of the array resonating at one frequency and the other resonating at a different one. It may also be possible to stack the designs, with the DR being a low loss alternative to stacking lossy conductive layers on top of one another.

Examples

The present invention is further illustrated by the following specific examples, which should not be construed as limiting the scope or content of the invention in any way.

Figure 3A:
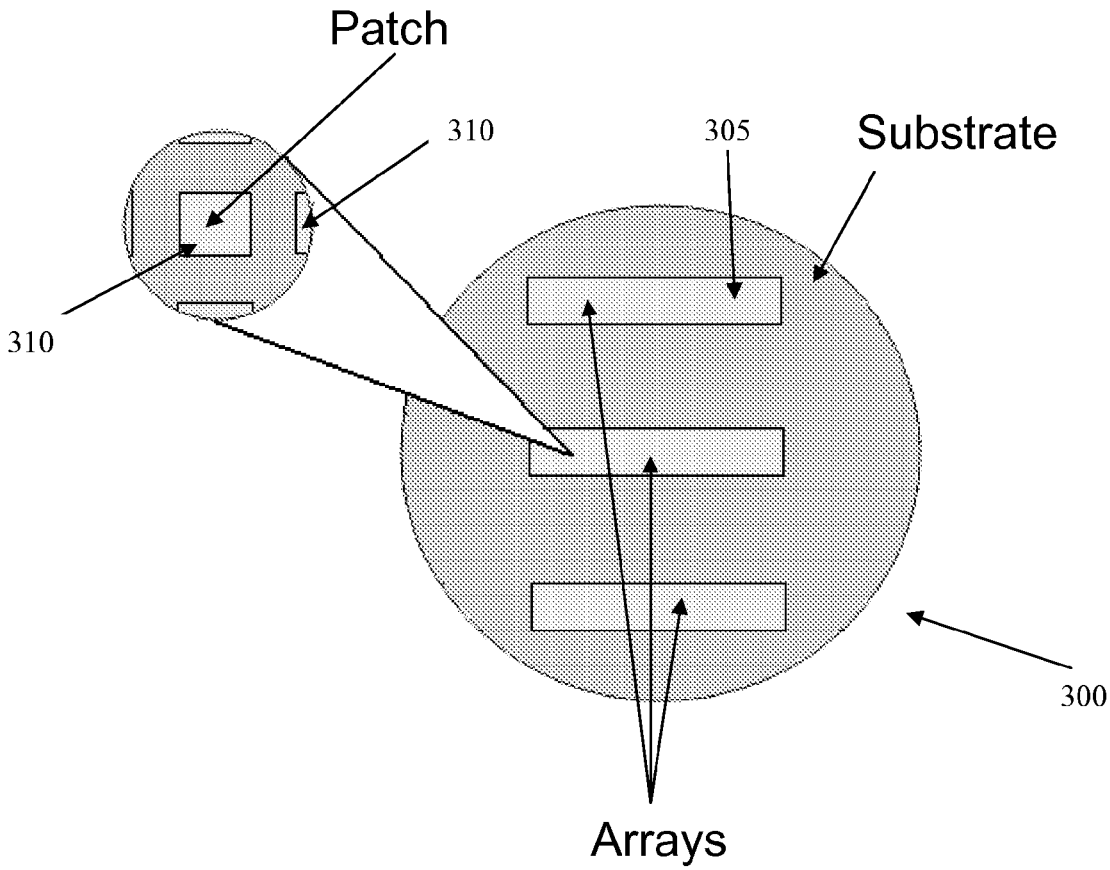
FIG. 3(*a*) is a depiction of an initial design layout of a reflectarray proof of concept wafer based on electrically conductive microscale elements to form an electrically conductive reflectarray (CR). Three (3) stripes are shown, with patch details for one of the three (3) stripes also provided.
Figure 3B:
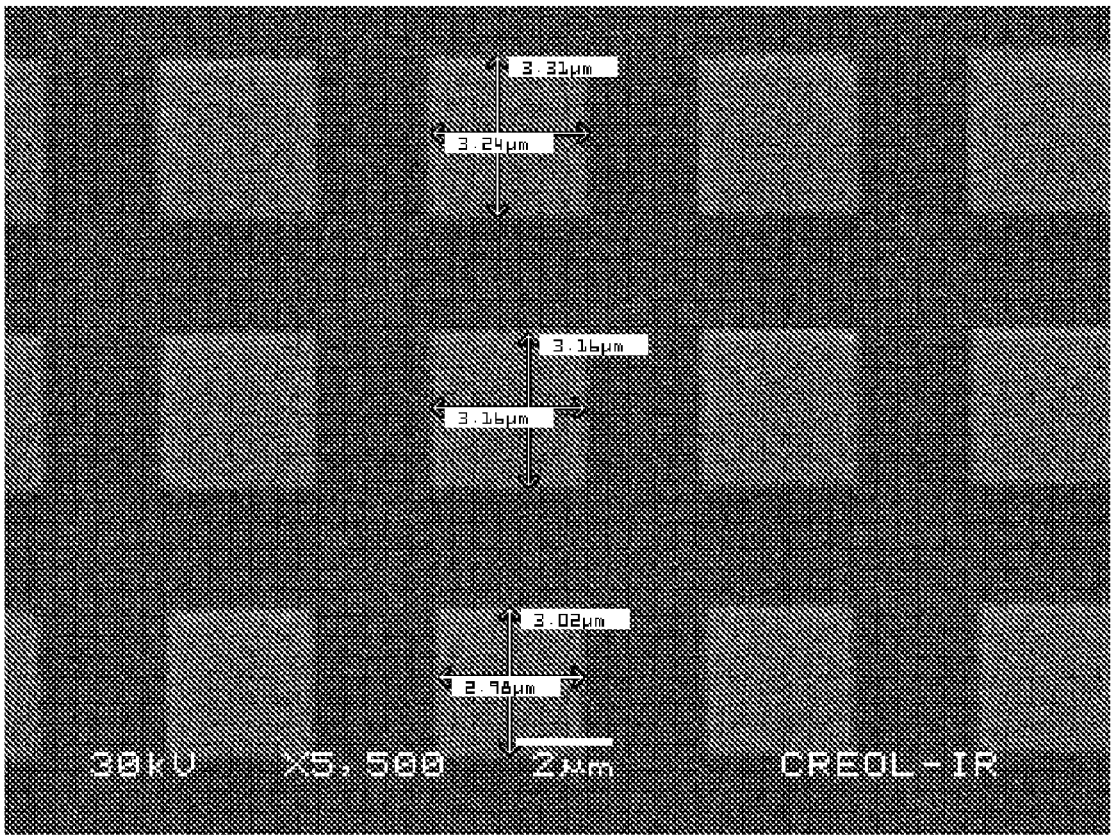

Fabrication was performed using an initial proof of concept CR design 300 shown in FIG. 3(*a*). Each of the three (3) stripes 305 included a plurality of metal patches 310. Such a design is not a practical design. The first step involved verifying a variable-size-patch reflectarray at infrared frequencies. An optically flat fused silica substrate having a $ZrO_2$ dielectric (480 nm) backed by a gold ground plane with three rows (stripes) of identical-element arrays with each row made up of different sized gold square patches (2.98, 3.14, and 3.24 μm for the first proof of concept device and 2.82, 2.90, and 3.48 μm for the second proof of concept device) being 150 nm thick was fabricated. FIG. 3(*b*) is a scanned image showing three (3) rows of elements, the rows being equally spaced, with each row having different size elements. The unit cell size was held constant at 5.54 μm by 5.54. The fabrication process comprised depositing a gold ground plane (reflective surface) on the back of the optical flat followed by a $ZrO_2$ dielectric layer on the topside of the optical flat. To adhere the gold to the optical flat and the $ZrO_2$ dielectric layer, a 10 nm Ti seed layer was utilized. Resist was spun on to the dielectric layer followed by pattern writing using E-beam lithography. The resist was developed to expose the desired pattern and the wafer surface was then metallized with the 10 nm Ti seed layer followed by gold deposition using an e-beam evaporation process. A resist lift-off process was then used to remove excess metal and resist and reveal the metallized pattern.

Figure 4:
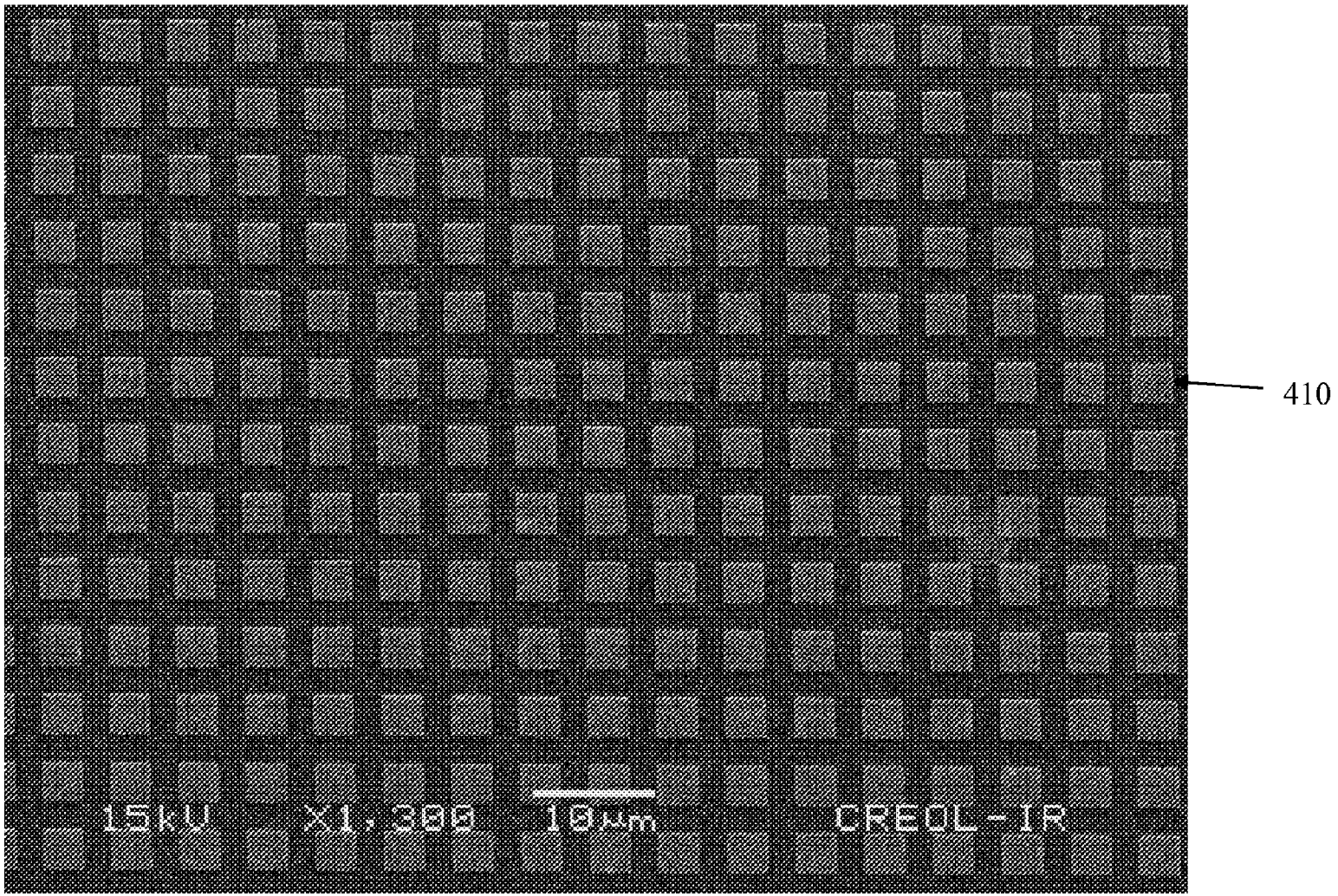
FIG. 4 shows a scanned image of a CR proof of concept wafer showing which has sufficient resolution to show the individual array elements within a stripe.

Each stripe on the optical flat contained 5,000 by 1,146 elements. The resulting SMR thus comprised 17.19 million elements. A scanned image of the resulting wafer is shown in FIG. 4 which has sufficient resolution to show the individual array elements 410 within one of the stripes.

To test the prototype CR fabricated, an interferometer was utilized to verify that a different phase shift was introduced by each stripe on the optical flat. FIGS. 5-7 are scanned images of the reflectarray taken by an interferometer operating at 28.28 THz and then smoothed in post processing. FIG. 5 is an interferogram of a coated flat with no patches (a control), showing no reflected phase modification. FIG. 6 is an interferogram with fringes across the device according to the invention illustrating variable phase modification between each stripe due to the variable patch sizes of the device. FIG. 7 is an interferogram with fringes across the device illustrating variable phase modification between each stripe due to the variable patch sizes of the device, which is different then the first device.

This invention can be embodied in other forms without departing from the spirit or essential attributes thereof and, accordingly, reference should be had to the following claims rather than the foregoing specification as indicating the scope of the invention.

We claim:

1. An integrated sub-millimeter and infrared reflectarray, comprising:

a reflective surface;

a dielectric layer disposed on said reflective surface, and a subwavelength element array electromagnetically coupled to said reflective surface, said subwavelength element array comprising at least one of:

(i) a plurality of electrically conductive subwavelength elements on said dielectric layer, (ii) said dielectric layer comprising a plurality of dielectric subwavelength elements, and (iii) said dielectric layer comprising a plurality of embedded dielectric subwavelength elements, wherein said subwavelength element array in (i), (ii) and (iii) includes at least one of a plurality of substantially different microscale inter-element spacings and a plurality of substantially different microscale dimensions for said plurality of elements, wherein an operating frequency band provided by said reflectarray is in a range between 1 THz and 500 THz.

2. The reflectarray of claim 1, wherein said array comprises said (i) plurality of electrically conductive subwavelength elements on said dielectric layer.

3. The reflectarray of claim 1, wherein said element array includes said plurality of substantially different microscale inter-element spacings.

4. The reflectarray of claim 1, wherein said plurality of embedded dielectric subwavelength elements comprise voids in said dielectric layer.

5. The reflectarray of claim 4, wherein said plurality of embedded dielectric subwavelength elements comprise a dielectric material having a dielectric constant lower than a dielectric constant material comprising said dielectric layer.

6. The reflectarray of claim 1, wherein said array comprises ii) said dielectric layer comprising a plurality of dielectric subwavelength elements.

7. The reflectarray of claim 1, where said plurality of subwavelength elements have a length and width dimensions both from 1 to 10 microns.

8. The reflectarray of claim 1, wherein said dielectric layer comprises $ZrO_2$ or BCB.

9. The reflectarray of claim 1, wherein said subwavelength element array comprises said (i) plurality of electrically conductive subwavelength elements on said dielectric layer, said (i) plurality of electrically conductive subwavelength elements comprising hundreds of thousands, millions, or billions of said electrically conductive subwavelength elements.

10. The reflectarray of claim 1, wherein said subwavelength element array comprises said (ii) dielectric layer comprising a plurality of dielectric subwavelength elements, said (ii) plurality of dielectric subwavelength elements comprising hundreds of thousands, millions, or billions of said dielectric subwavelength elements.

11. The reflectarray of claim 1, wherein said subwavelength element array comprises said (iii) dielectric layer comprising a plurality of embedded dielectric subwavelength elements, said (iii) plurality of embedded dielectric subwavelength elements comprising hundreds of thousands, millions, or billions of said embedded dielectric subwavelength elements.

12. An integrated sub-millimeter and infrared reflectarray, comprising:

a reflective surface;

a dielectric layer disposed on said reflective surface, and a subwavelength element array electromagnetically coupled to said reflective surface, said subwavelength element array comprising at least one of:

(i) a plurality of electrically conductive subwavelength fixed thickness elements on said dielectric layer;

(ii) said dielectric layer comprising a plurality of dielectric subwavelength fixed thickness elements, and (iii) said dielectric layer comprising a plurality of embedded dielectric subwavelength fixed thickness elements, wherein said subwavelength element array in (i), (ii) and (iii) includes at least one of a plurality of substantially different microscale inter-element spacings and a plurality of substantially different microscale dimensions for said plurality of element; wherein an operating frequency band provided by said reflectarray is in range 1 THz and 500 THz.

* * * * *